US011147381B2

(12) United States Patent
DuFresne

(10) Patent No.: US 11,147,381 B2
(45) Date of Patent: Oct. 19, 2021

(54) ADJUSTABLE CHAIR SUPPORT SYSTEM

(71) Applicant: THE COMFORT COMPANIES, LLC, Bozeman, MT (US)

(72) Inventor: Steven DuFresne, Hartland, WI (US)

(73) Assignee: THE COMFORT COMPANIES, LLC, Bozeman, MT (US)

( * ) Notice: Subject to any disclaimer, the term of this patent is extended or adjusted under 35 U.S.C. 154(b) by 0 days.

(21) Appl. No.: 16/821,303

(22) Filed: Mar. 17, 2020

(65) Prior Publication Data

US 2020/0214454 A1 Jul. 9, 2020

Related U.S. Application Data

(62) Division of application No. 16/391,829, filed on Apr. 23, 2019, now Pat. No. 10,595,639, which is a division of application No. 15/995,854, filed on Jun. 1, 2018, now Pat. No. 10,264,891, which is a division of application No. 15/331,625, filed on Oct. 21, 2016, now Pat. No. 9,986,840.

(60) Provisional application No. 62/244,694, filed on Oct. 21, 2015.

(51) Int. Cl.

| | |
|---|---|
| ***A47C 7/42*** | (2006.01) |
| ***A47C 7/46*** | (2006.01) |
| ***A61G 5/10*** | (2006.01) |

(52) U.S. Cl.

CPC ..... *A47C 7/465* (2013.01); *A47C 7/42* (2013.01); *A61G 5/1048* (2016.11)

(58) Field of Classification Search

CPC .... A61G 5/122; A61G 5/1091; A61G 5/1043; A61G 5/12; A61G 5/1067; A61G 5/1048; A61G 2005/122; A61G 2005/1091; A47C 7/465; A47C 7/282; A47C 7/3228; A47C 7/42; A47C 5/06; B60N 2/4415

USPC ..... 297/284.2, 218.1, DIG. 6, 204, 452.63, 297/452.64, 284.1; 24/19, 32

See application file for complete search history.

(56) References Cited

U.S. PATENT DOCUMENTS

| | | | |
|---|---|---|---|
| 229,085 | A | 6/1880 | Boyers |
| 1,987,921 | A | 1/1935 | Bertsch |
| 2,182,253 | A | 12/1939 | Farrell |
| 3,258,259 | A | 6/1966 | Bohlin |
| 4,155,592 | A | 5/1979 | Tsuda et al. |
| 4,309,058 | A | 7/1982 | Barley |
| 4,462,635 | A | 7/1984 | Lance |
| 4,545,614 | A | 10/1985 | Abu-Isa et al. |
| 4,547,918 | A | 10/1985 | Ginpil et al. |
| 4,630,865 | A | 12/1986 | Ahs |
| 4,712,834 | A | 12/1987 | Warrick |
| 4,858,992 | A | 8/1989 | LaSota |

(Continued)

FOREIGN PATENT DOCUMENTS

| | | | |
|---|---|---|---|
| GB | 2035792 | A | 6/1980 |
| GB | 2362818 | A | 12/2001 |

*Primary Examiner* — Mark R Wendell
(74) *Attorney, Agent, or Firm* — Michael Best & Friedrich LLP

(57) ABSTRACT

An adjustable chair support system includes a first seat back support member spaced from a second seat back support member, and a seat back tensioning assembly extending between the first and second seat back support members, the seat back tensioning assembly includes a carrier, an adjustable tension member coupled to the carrier, and a cable, wherein the cable extends between the first and second seat back support members a plurality of times, and wherein the adjustable tension member is configured to adjust a tension of the cable.

19 Claims, 15 Drawing Sheets

(56) References Cited

U.S. PATENT DOCUMENTS

| | | | |
|---|---|---|---|
| 5,023,125 | A | 6/1991 | Gray |
| 5,058,952 | A | 10/1991 | LaSota |
| 5,342,111 | A | 8/1994 | Charles |
| 5,403,067 | A | 4/1995 | Rajaratnam |
| 5,700,060 | A | 12/1997 | Bullard et al. |
| 5,860,700 | A | 1/1999 | Lance |
| 5,867,852 | A | 2/1999 | Knight |
| 5,954,399 | A | 9/1999 | Hong |
| 5,957,532 | A | 9/1999 | Watkins |
| 6,082,825 | A | 7/2000 | Simon |
| 6,536,791 | B1 | 3/2003 | Adams |
| 6,601,919 | B1 | 8/2003 | Deceuninck |
| 6,644,740 | B2 | 11/2003 | Holst et al. |
| 6,692,074 | B1 | 2/2004 | Kopetzky et al. |
| 6,938,959 | B1 | 9/2005 | Borunda et al. |
| 6,971,717 | B1 | 12/2005 | Rhodes |
| 7,128,372 | B2 | 10/2006 | Farquhar et al. |
| 7,467,426 | B1 | 12/2008 | Jarmon et al. |
| 7,841,661 | B2 | 11/2010 | Samain et al. |
| 2006/0138831 | A1 | 6/2006 | McMillien et al. |
| 2008/0079298 | A1 | 4/2008 | Whelan et al. |
| 2009/0115234 | A1 | 5/2009 | Samain |
| 2010/0066056 | A1 | 3/2010 | Li et al. |
| 2010/0264708 | A1 | 10/2010 | Rajaratnam |
| 2010/0276974 | A1 | 11/2010 | Huttenhuis |
| 2011/0095588 | A1 | 4/2011 | Jen et al. |
| 2011/0187177 | A1 | 8/2011 | Flanigan |
| 2011/0221253 | A1 | 9/2011 | Saez et al. |
| 2013/0334787 | A1 | 12/2013 | Gosseen et al. |
| 2015/0076879 | A1 | 3/2015 | Line et al. |
| 2015/0223608 | A1 | 8/2015 | Capra et al. |
| 2015/0232185 | A1 | 8/2015 | Johnson et al. |
| 2015/0258925 | A1 | 9/2015 | An |

ADJUSTABLE CHAIR SUPPORT SYSTEM

CROSS-REFERENCE TO RELATED APPLICATIONS

This application is a divisional of U.S. patent application Ser. No. 16/391,829, filed on Apr. 23, 2019, and entitled "Adjustable Chair Support System," which is a divisional of U.S. patent application Ser. No. 15/995,854, now U.S. Pat. No. 10,264,891, filed on Jun. 1, 2018, and entitled "Adjustable Chair Support System," which is a divisional of U.S. patent application Ser. No. 15/331,625, now U.S. Pat. No. 9,986,840, filed on Oct. 21, 2016, and entitled "Adjustable Chair Support System," which claims priority to U.S. Provisional Patent Application No. 62/244,694, filed on Oct. 21, 2015, and entitled "Adjustable Chair Support System," the contents of each is hereby incorporated by reference in its entirety.

FIELD OF THE DISCLOSURE

The present disclosure relates to an adjustable chair support system. More specifically, the present disclosure relates to a lightweight, adjustable chair support system that is adjustable while sitting in the chair.

SUMMARY

In one embodiment, an adjustable chair support system includes a first seat back support member spaced from a second seat back support member, and a seat back tensioning assembly that extends between the first and second seat back support members. The seat back tensioning assembly includes a carrier coupled to the first seat back support member, the carrier including an adjustable tension member and a first guide member, a pair of second guide members coupled to the second seat back support member, and a cable extending from the adjustable tension member into engagement with one of the pair of second guide members, with the first guide member, with the other of the pair of second guide members, and then returning to the adjustable tension member.

Other aspects of the invention will become apparent by consideration of the detailed description and accompanying drawings.

DETAILED DESCRIPTION

Before embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

While the present disclosure illustrates an adjustable chair support system 10 for use with a wheelchair, it should be appreciated that a wheelchair is provided for purposes of illustration and is not limiting. The adjustable chair support system 10 can be used not only with a wheelchair, but also in association with any suitable chair, including, but not limited to, an armchair, rocking chair, car seat, swivel chair, office chair, recliner, director's chair, high chair, sofa, backed stool, or any other suitable device for supporting a person while sitting.

Figure 1:
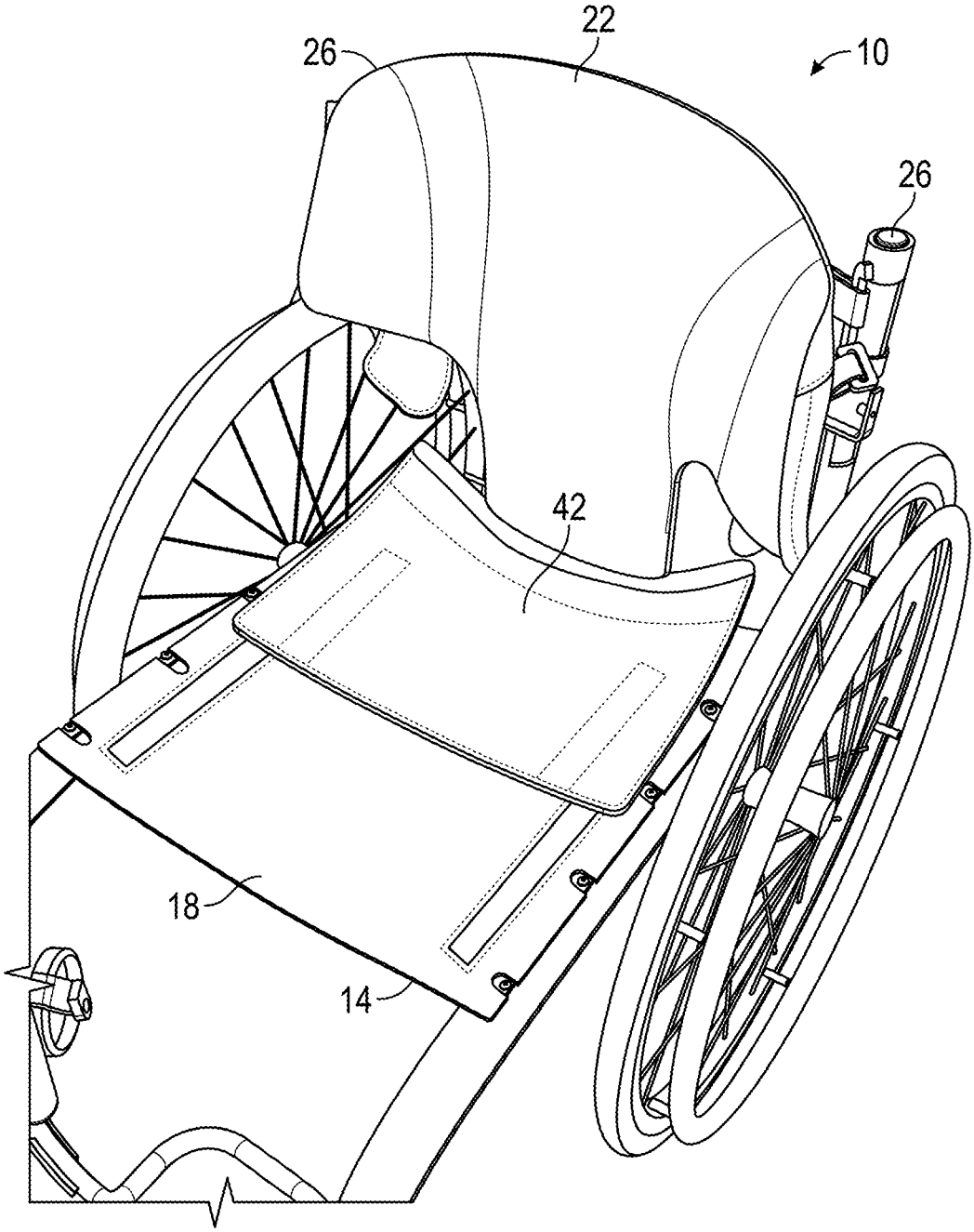
FIG. 1 is a perspective view of an embodiment of an adjustable chair support system for use with a chair, illustrated as a wheelchair.

Referring to FIG. 1, an embodiment of the adjustable chair support system 10 is illustrated in association with a chair 14. In this embodiment, the chair 14 is shown as a wheelchair 14. The chair 14 generally includes a seat 18 and a seat back or back pad 22. The seat 14 can be configured to support a seat or seat pad 24 (shown in FIG. 10). The seat back 22 is positioned between opposing seat back support members or seat back frame members 26. The illustrated embodiment depicts the seat back support members 26 as opposing canes 26 of the wheelchair 14. However, in other embodiments the seat back support members 26 can be any suitable member(s) or support member(s) configured to attach or carry the adjustable chair support system 10.

Figure 2:
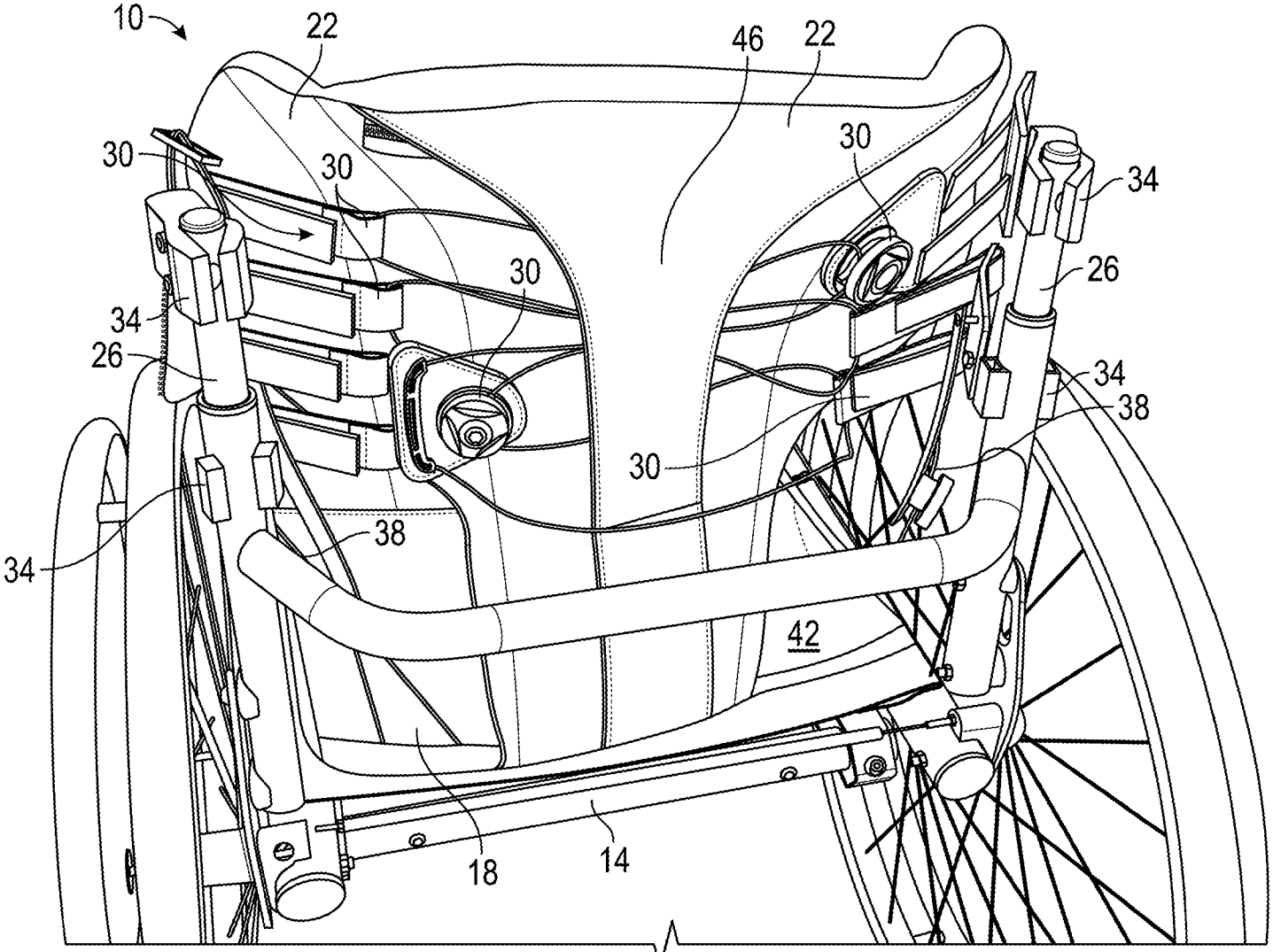
FIG. 2 is a perspective view of a back side of the chair of FIG. 1, illustrating the adjustable chair support system.

FIG. 2 is a perspective view of a back side of the chair 14 of FIG. 1. The adjustable chair support system 10 includes a seat back tensioning assembly 30, a seat back width and depth adjustment assembly 34, and a seat bottom adjustment assembly 38. The seat back tensioning assembly 30 provides for adjustability of the tension in the seat back 22, allowing for selective adjustment of comfort and support for a user of the chair 14. The seat back width and depth adjustment assembly 34 is coupled to the seat back support members 26 and provides for selective adjustment of a width and a depth of the seat back 22. The seat bottom adjustment assembly 38 is coupled to the seat 18 or a portion of the seat (such as a seat flap 42 that is positioned under a seat cushion) to adjust a position of the seat 18 to improve support and increase surface area in contact with a user to better redistribute pressure (and improve comfort while also acting as an orthotic to change pelvis position during use). In the illustrated embodiment, the seat back 22 couples to the seat back tensioning assembly 30 by a flap or back flap 46 that receives a portion of the seat back tensioning assembly 30. More specifically, a portion of the seat back tensioning assembly 30 can be positioned between the seat back 22 and the back flap 46. The back flap 46 can include a self-attachment assembly that selectively and removably fastens the back flap 46 to the seat back tensioning assembly 30. In the illustrated embodiment, the self-attachment assembly is a hook-and-loop type fastener (e.g., Velcro, etc.). However, in other embodiments, any suitable fastener that facilitates an attachment (e.g., a snap button or snap fastener, a snap hook, etc.) can be used.

Figure 3:
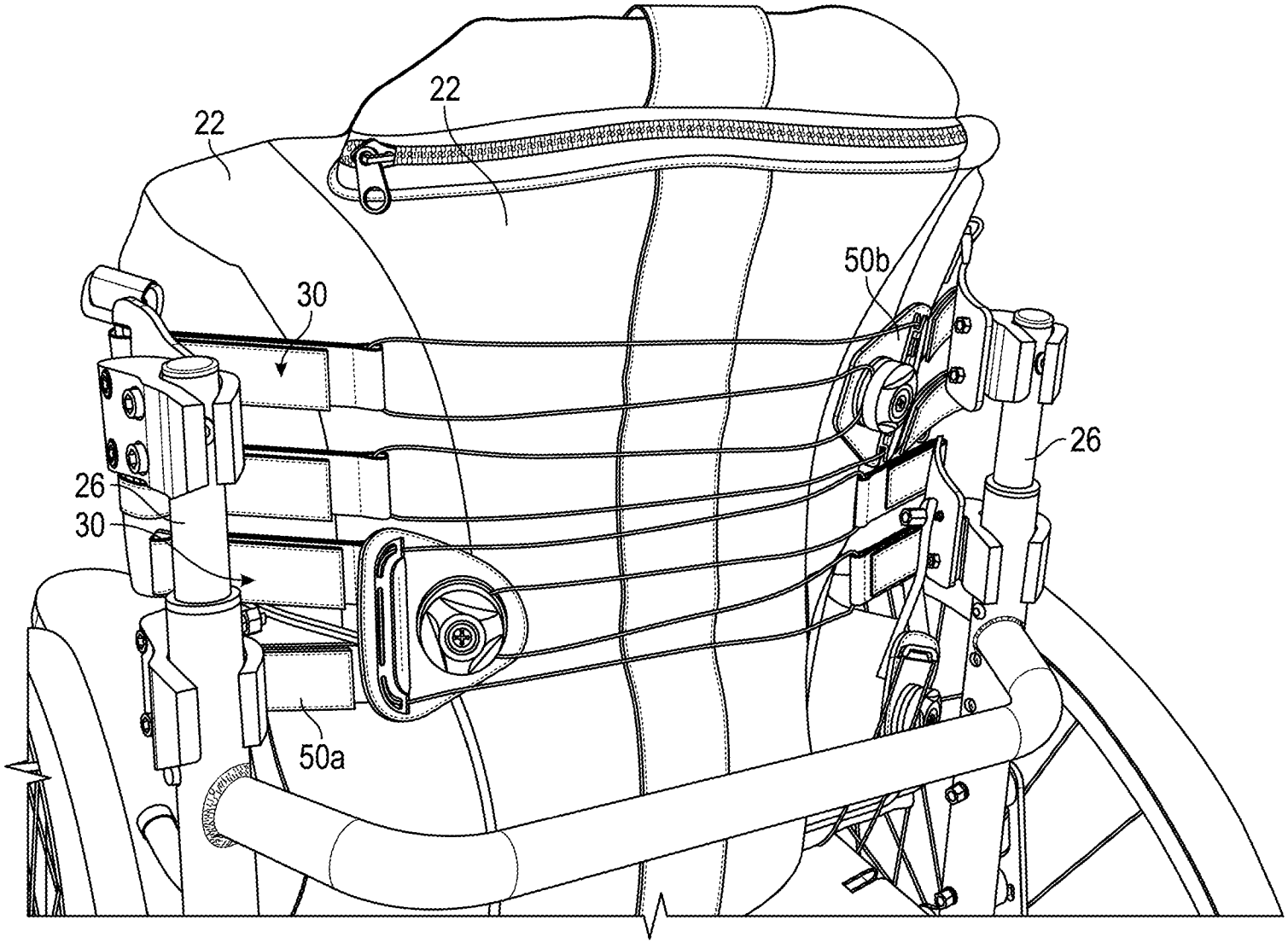
FIG. 3 is a first perspective view of the back side of the chair of FIG. 2, with a back flap removed to better illustrate the adjustable chair support system.
Figure 4:
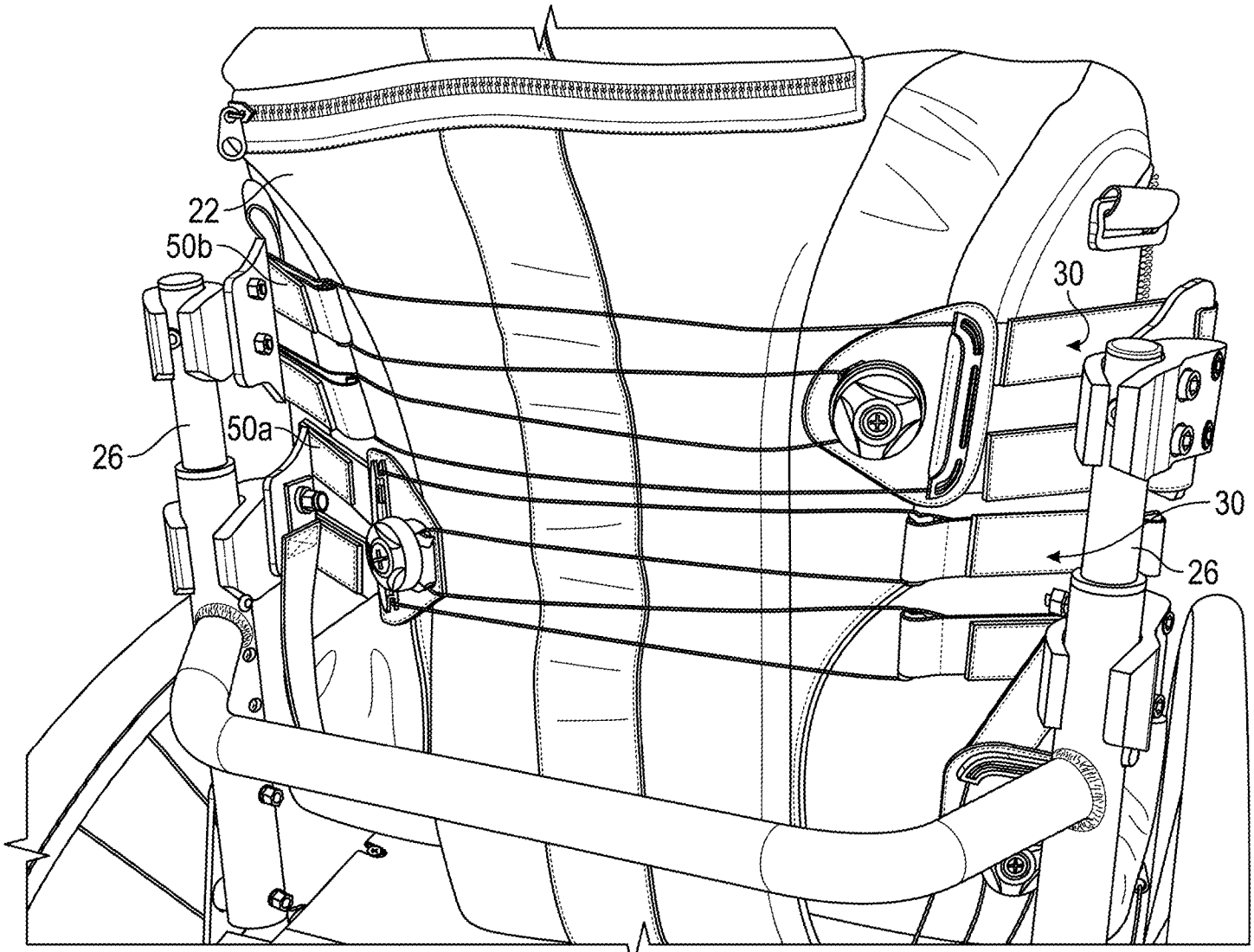
FIG. 4 is a second perspective view of the back side of the chair of FIG. 2, with the back flap removed to better illustrate the adjustable chair support system.

FIGS. 3-4 illustrate the seat back 22 with the back flap 46 removed to further illustrate the seat back tensioning assembly 30. In this embodiment, the seat back tensioning assembly 30 includes a plurality of tension adjustment members 50*a, b*. While the illustrated embodiment illustrates two tension adjustment members 50*a, b*, in other embodiments any number of tension adjustment members 50 can be used (e.g., one, two, three, or more).

Figure 5:
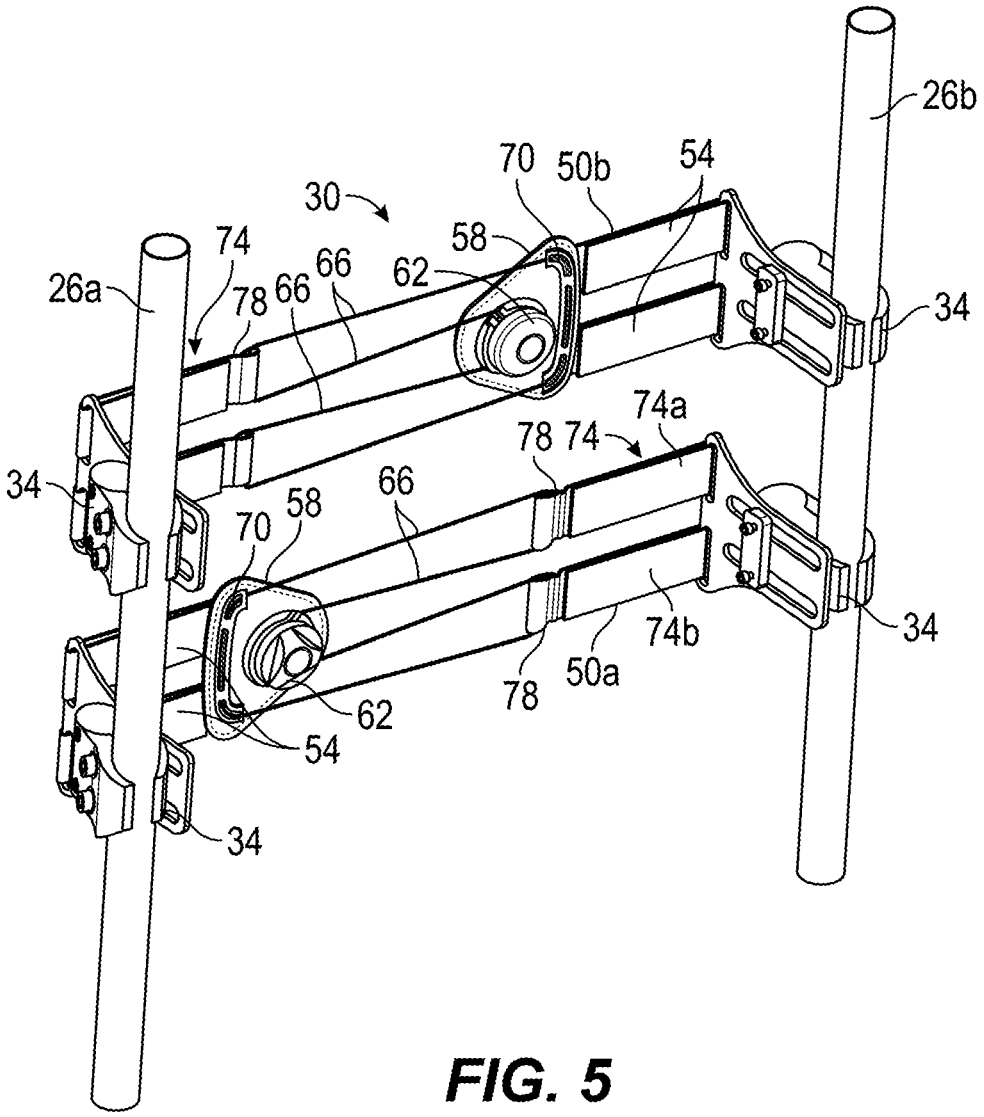
FIG. 5 is a perspective view of the back side of the chair of FIG. 2, with the seat back and other chair components removed to illustrate the adjustable chair support system attached to seat back support members.

FIG. 5 illustrates the seat back tensioning assembly 30 with the seat back 22 removed. A first tension adjustment member 50*a* is coupled to and extends between the spaced apart seat back support members 26. The seat back support members 26 can be referred to as a first seat back support member 26*a*, and a second seat back support member 26*b*. The first tension adjustment member 50*a* includes a first strap portion 54 that is coupled to the first seat back support member 26*a*. The first strap portion 54 is illustrated as two separate straps, but in other embodiments can be a single strap or three or more straps. The first strap portion 54 is coupled to a tension adjustment carrier 58. The carrier 58 carries an adjustable tension member 62 that is configured to adjust a tension of a cable 66. The adjustable tension member 62 can be a ratchet assembly, a ratchet actuator, or any other suitable assembly for adjusting a tension of the cable 66. For example, the tension of the cable 66 can be adjusted by selectively increasing or decreasing a length of the cable 66 that extends between the seat back support member 26*a, b*. The carrier 58 can also carry a first guide member 70 (or guide channel 70) to provide a path for the cable 66 with respect to the carrier 58. The path provided by the first guide member 70 can reduce friction as the length of the cable 66 that extends between the seat back support members 26*a, b* is selectively increased or decreased, while also guiding the cable 66 between the seat back support members 26*a, b*. The first guide member 70 can further provide one or more additional runs of the cable 66 (e.g., passes of the cable 66 between the first strap portion 54 and a second strap portion 74) to increase a surface area of the cable 66 that is exposed to a user of the adjustable chair support system 10. The cable 66 extends from the carrier 58 to engage the second strap portion 74. In the illustrated embodiment, the second strap portion 74 is illustrated as two separate straps 74*a*, 74*b* (or strap portions 74*a*, 74*b*). However, in other embodiments, the second strap portion 74 can include one strap, or three or more straps. Each second strap portion 74*a*, 74*b* can include (or define) a second guide member or channel 78. Each second guide member 78 can define (or otherwise provide) a path for the cable 66. The path provided by the second guide channels 78 can guide the cable 66 back to the adjustable tension member 62. In addition, the second guide channels 78 can reduce friction as the length of the cable 66 that extends between the seat back support members 26*a, b* is selectively increased or decreased. The second strap portion 74 is coupled to the second seat back support member 26*b*. It should be appreciated that the cable 66 is a single cable that extends one or more times between the seat back support members 26*a, b*. In the illustrated embodiment, the cable 66 extends a plurality of time between first strap portion 54 and the second strap portion 74. This allows a single adjustable tension member 62 to adjust a tension of the cable 66, and more specifically an associated length of exposed cable 66.

The second tension adjustment member 50*b* is substantially the same as the first tension adjustment member 50*a*, with like numbers identifying like components. In the illustrated embodiment, the adjustable tension member 62 of the first tension adjustment assembly 50*a* is positioned closer to the first seat back support member 26*a*, while the adjustable tension member 62 of the second tension adjustment assembly 50*b* is positioned closer to the second seat back support member 26*b*. By alternating or offsetting the position of the adjustable tension member 62 in relation to the seat back support members 26*a*, 26*b*, a greater amount of tension control is realized. Increasing tension control can provide additional control of support and comfort for a user. In other embodiments, the adjustable tension member 62 of the first tension adjustment assembly 50*a* can be positioned closer to the second seat back support member 26*b*, while the adjustable tension member 62 of the second tension adjustment assembly 50*b* can be positioned closer to the first seat back support member 26*a*.

To adjust a tension of the cable 66 for each tension adjustment member 50, each associated adjustable tension member 62 can be rotated to position a desired exposed length of cable 66. The desired exposed length of the cable 66 (e.g., either a longer or a shorter exposed length of the cable 66) can be selected based on a comfort of a user, proper sitting position, position of each tension adjustment member 50, and/or as an orthotic to achieve a desired outcome for the user. In other embodiments of the adjustable tension member 62, the exposed length of the cable 66 can be adjusted in a different manner. For example, the adjustable tension member 62 can be rotated in a first direction to decrease an exposed length of cable 66. To increase an exposed length of cable 66, the adjustable tension member 62 can be translated (or slide) along an axis of rotation (e.g., perpendicular to the carrier 58) to release the cable 66 from the adjustable tension member 62.

Figure 6:
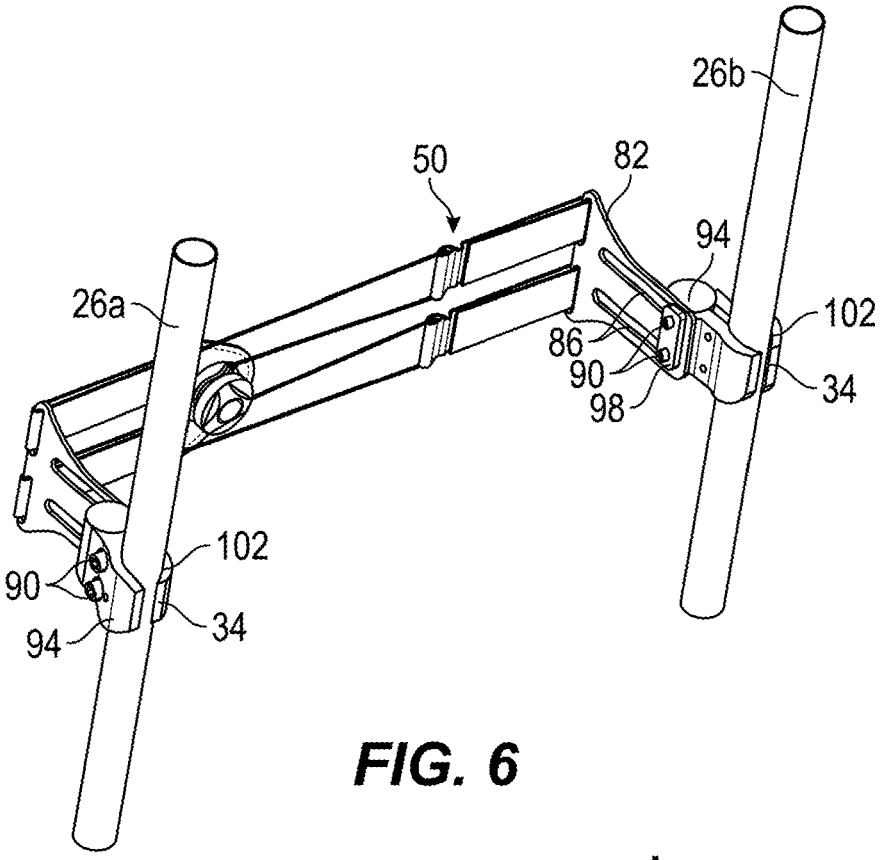
FIG. 6 is a perspective view of a tension adjustment member of FIG. 5, illustrating a first depth position adjustable by a seat back width and depth adjustment assembly.
Figure 7:
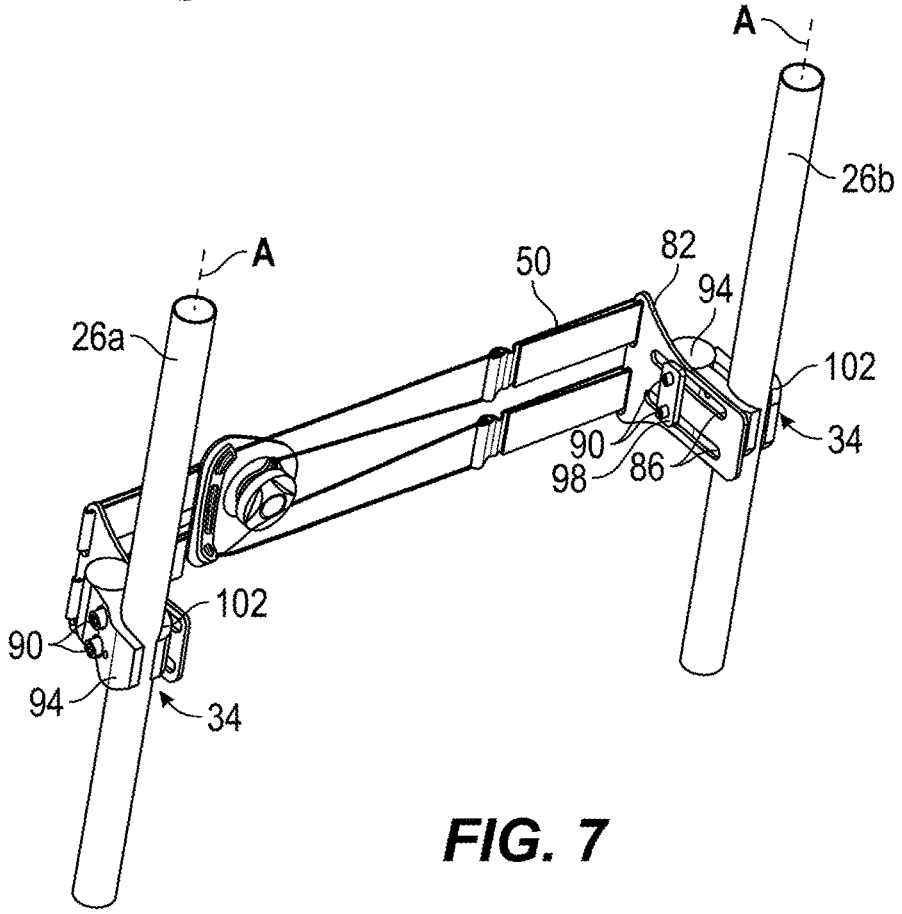
FIG. 7 is a perspective view of the tension adjustment member of FIG. 6, illustrating a second depth position adjustable by the seat back width and depth adjustment assembly.

Each tension adjustment member 50*a, b* can respectively connect to the seat back support members 26*a, b* by the seat back width and depth adjustment assembly 34. FIGS. 6-7, illustrate one of the tension adjustment members 50 coupled to the seat back width and depth adjustment assembly 34. The seat back width and depth adjustment assembly 34 includes a first depth adjustment bracket 82 that defines at least one channel 86 (or hole 86). In the illustrated embodiment, the bracket 82 includes a pair of channels 86. In other embodiments, any number of channels 86 may be used to provide depth adjustment. Each channel 86 attaches to a width adjustment bracket 94 by an associated fastener 90 (shown as a screw 90). Each fastener 90 is received by a respective aperture in the width adjustment bracket 94 and is received by one of the channels 86. A retention bracket 98 can also receive each fastener 90 to facilitate a connection between the depth adjustment bracket 82 and the width adjustment bracket 94. The retention bracket 98 is positioned on a side of the bracket 82 opposite the width adjustment bracket 94. The width adjustment bracket 94 also defines a channel 102 that is configured to receive, couple to, or otherwise engage one of the seat back support members 26. In the illustrated embodiment, the width adjustment bracket 94 is shown as a cane clamp 94.

To adjust a depth of each tension adjustment member 50 in relation to the associated back support member 26, the depth adjustment bracket 82 is laterally adjusted relative to the width adjustment bracket 94 such that each fastener 90 slides within the associated channel 86. To illustrate the adjustment, FIG. 6 illustrates the depth adjustment bracket 82 in a first depth position or first depth configuration. In this first depth configuration, the tension adjustment member 50 is positioned away from the seat back support members 26*a, b*. FIG. 7 illustrates the first depth adjustment bracket 82 in a second depth position or second depth configuration. In this second depth configuration, the tension adjustment member 50 is positioned closer to (or towards) the seat back support members 26*a, b*. In addition, or alternatively, to adjust the depth of the seat back tensioning assembly 30 in relation to the associated back support members 26*a, b*, the adjustable tension member 62 can be actuated to increase or decrease the length of exposed cable 66. Exposing more cable 66 (e.g., increasing the length of exposed cable 66) can provide an increase in depth relative to the back support members 26*a, b*, while exposing less cable 66 (e.g., decreasing the length of exposed cable 66) can provide a decrease in depth relative to the back support members 26*a, b*.

Figure 8:
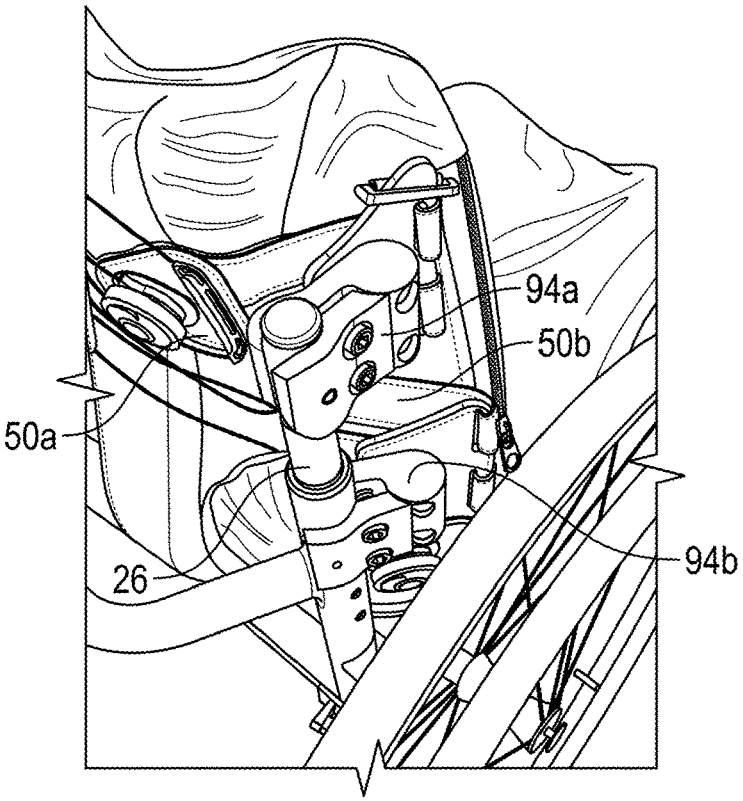
FIG. 8 is a perspective view of the back side of the chair of FIG. 1, illustrating width adjustment of each tension adjustment member with a first tension adjustment member in a first width and a second tension adjustment member in a second width.
Figure 9:
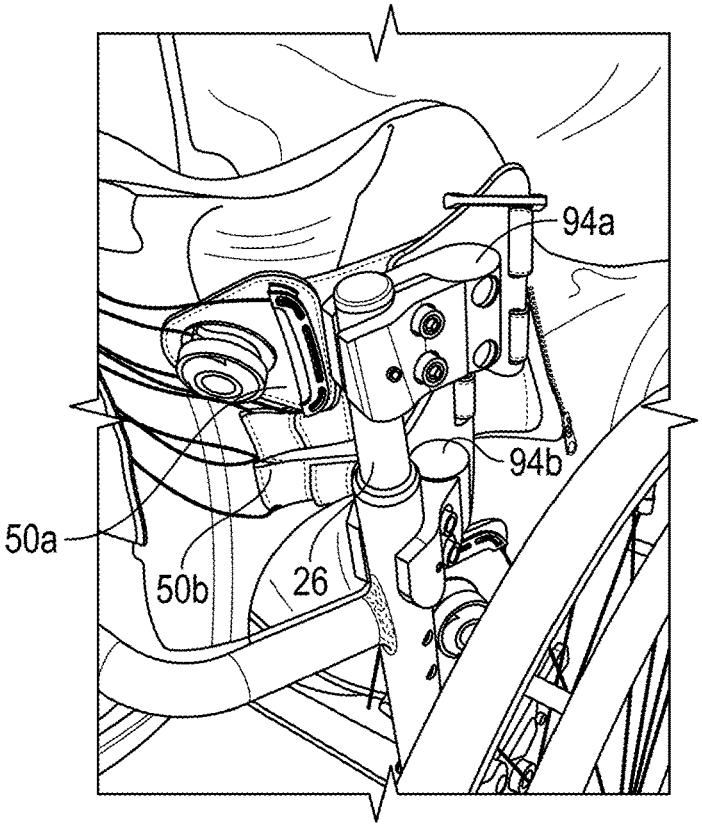
FIG. 9 is a perspective view of the back side of the chair of FIG. 8, illustrating a width adjustment of each tension adjustment member with the first tension adjustment member in a third width less than the first width, and the second tension adjustment member in a fourth width greater than the second width.

To adjust a width of each tension adjustment member 50 in relation to the back support members 26, each width adjustment brackets 94 is configured to rotate with respect to the back support member 26 to which it is configured to attach. Stated another way, each width adjustment bracket 94 rotates about, or with respect to, an axis A (shown in FIG. 7) that is defined by the respective back support member 26. With reference now to FIGS. 8-9, an example of the width adjustability of each tension adjustment member 50 is illustrated. In both FIGS. 8-9, consecutive width adjustment brackets 94*a, b*, which are respectively associated with consecutively positioned tension adjustment members 50*a, b*, are shown attached to the back support member 26. Each width adjustment bracket 94*a, b* is pivotally connected to, or rotatable with respect to, the back support member 26. In FIG. 8, the width adjustment bracket 94*a* is rotated with respect to the back support member 26 inward, or towards the tension adjustment member 50*a*. This narrows the width of the tension adjustment member 50*a*. The width adjustment bracket 94*b* is rotated with respect to the back support member 26 outward, or away from the tension adjustment member 50*b*. This increases the width of the tension adjustment member 50*b*. Each width adjustment bracket 94*a, b* is independently and separately adjustable rotated with respect to the associated back support member 26. As illustrated in FIG. 9, the width adjustment bracket 94*a* is rotated with respect to the back support member 26 outward, or away from the tension adjustment member 50*a*. This increases the width of the tension adjustment member 50*a*. The width adjustment bracket 94*b* is rotated with respect to the back support member 26 inward, or towards the tension adjustment member 50*b*. This decreases the width of the tension adjustment member 50*b*. While FIGS. 8-9 illustrate one end of the tension adjustment members 50*a, b* that attaches to one of the back support members 26, it should be appreciated that a substantially similar connection can be made between each tension adjustment member 50*a, b* and the other back support member(s) 26.

To adjust a height of each tension adjustment member 50 in relation to the back support members 26, each width adjustment bracket 94 is configured to slide, or slidably engage, with respect to the back support member 26 to which it attaches. Stated another way, each width adjustment brackets 94 can slide along the associated back support members 26 to a desired height or position on the associated back support members 26.

Figure 10:
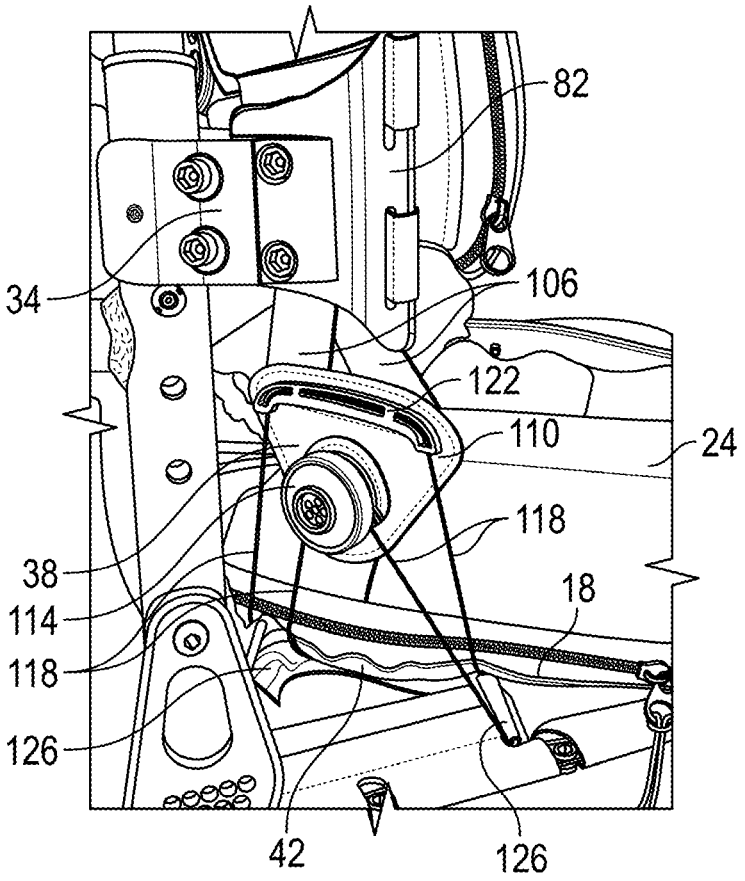
FIG. 10 is a side elevation view of the chair of FIG. 1 illustrating a seat bottom adjustment assembly.

FIG. 10 illustrates an embodiment of the seat bottom adjustment assembly 38. In the illustrated embodiment, the seat bottom adjustment assembly 38 is coupled to the seat 18 and the back support member 26. More specifically, the seat bottom adjustment assembly 38 is coupled to the seat back width and depth adjustment assembly 34, for example by the depth adjustment bracket 82. In other embodiments, the seat bottom adjustment assembly 38 can be coupled to any suitable portion of the chair 14, such as a back support member 26, a seat back tensioning assembly 30, or any other suitable structure. While FIG. 10 illustrates one seat bottom adjustment assembly 38, the chair 14 can have at least two seat bottom adjustment assemblies 38. Each of the seat bottom adjustment assemblies 38 can be positioned in a corner of the chair 14 towards a seat back end of the seat 18 (e.g., a corner at an end of the seat 18 closest to the seat back 22, as shown in FIG. 1). Each seat bottom adjustment assembly 38 is configured to reposition a portion of the seat 18 (and/or the seat pad 24, etc.) by lifting and/or curling a portion of the seat 18, such as the seat flap 42, and a portion of the associated seat pad 24, upwards or towards a sitting user (or downwards or away from a sitting user). To facilitate this adjustment, each seat bottom adjustment assembly 38 includes a first strap portion 106 that is coupled to a seat back support member 26 (such as the nearest seat back support member 26). In the illustrated embodiment, the first strap portion 106 is coupled to the seat back support member 26 through the depth adjustment bracket 82. The first strap portion 106 is illustrated as two separate straps, but in other embodiments may be a single strap, or three or more straps. The first strap portion 106 is coupled to a tension adjustment carrier 110. The carrier 110 carries an adjustable tension member 114 that is configured to adjust a tension of a cable 118. The adjustable tension member 114 can be a ratchet assembly, a ratchet actuator, or any other suitable assembly for adjusting the tension of the cable 118. For example, the tension of the cable 118 can be adjusted by selectively increasing or decreasing a length of the cable 118 that extends between the carrier 110 and the seat 18. The adjustable tension member 114 can be substantially the same as the adjustable tension member 62. The carrier 110 can also carry a first guide member 122 (or guide channel 122) to provide a path (or guide path) for the cable 118 with respect to the carrier 110. The path provided by the guide member 122 can reduce friction as the length of the cable 118 that extends between the carrier 110 and the seat 18 (or seat flap 42) is selectively increased or decreased. The guide member 122 can further provide one or more additional runs of the cable 118 (e.g., passes of the cable 118 between the seat back support member 26 and the seat 18) to increase a surface area of the cable 118 that is exposed to a user of the adjustable chair support system 10. The cable 118 extends from the carrier 110 to engage the seat 18 by respective second guide members or guide channels 126. Each second guide member can be attached to or defined by a portion of the seat 18, such as the seat flap 42. The path provided by the second guide channels 126 can guide the cable 118 back to the adjustable tension member 114. Further, the second guide channels 126 have reduce friction as the length of the cable 118 that extends between the carrier 110 and the seat 18 is selectively increased or decreased. It should be appreciated that the cable 118 is a single cable that extends one or more times between the carrier 110 and the seat 18. Thus, a single adjustable tension member 114 can adjust a tension of the cable 118, and more specifically an associated length of exposed cable 118.

To adjust a position of the seat 18, and/or the associated seat pad 24, to provide additional support to a user, each adjustable tension member 114 can be rotated to position a desired exposed length of cable 118. As the adjustable tension member 114 rotates, the length of exposed cable 118 that extends between the carrier 110 and the seat 18 is either increased or decreased. As the length is decreased, the seat 18 is drawn towards the user sitting in the seat 18. As the length is increased, the seat 18 is positioned away from the user sitting in the seat 18. The desired exposed length of the cable 118 (e.g., either a longer or a shorter exposed length of the cable 118) can be selected based on a comfort of a user, proper sitting position, position of the seat 18 (and/or the associated seat pad 24), and/or as an orthotic to achieve a desired outcome for the user. In other embodiments of the adjustable tension member 114, the exposed length of the cable 118 can be adjusted in a different manner. For example, the adjustable tension member 114 can be rotated in a first direction to decrease an exposed length of cable 118. To increase an exposed length of cable 118, the adjustable tension member 114 can be translated (or slide) along an axis of rotation (e.g., perpendicular to the carrier 110) to release the cable 118 from the adjustable tension member 114.

Figure 13:
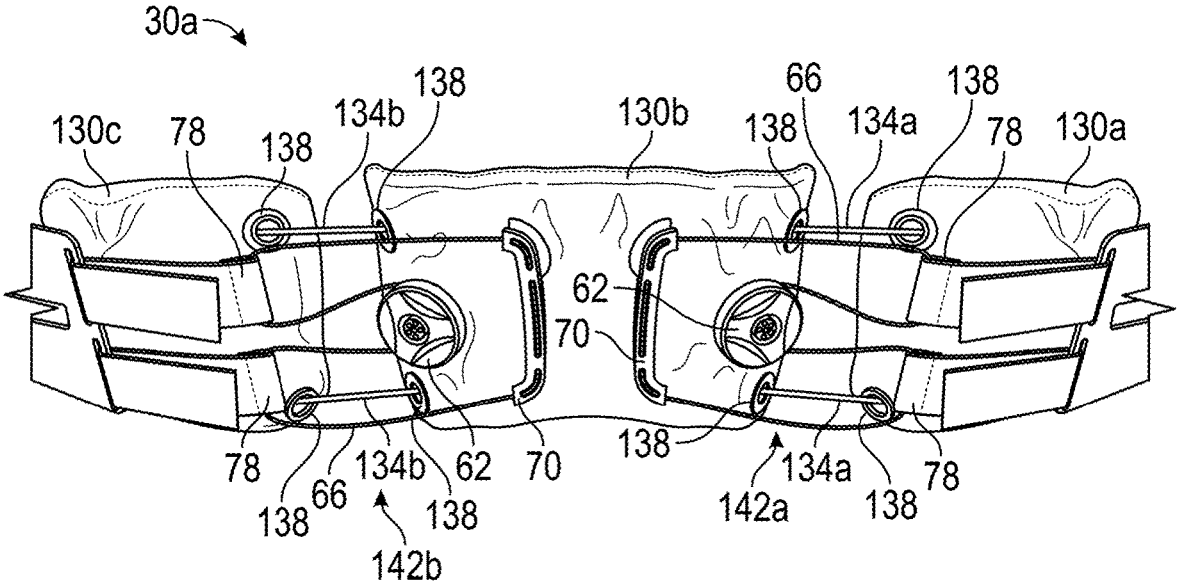
FIG. 13 is a perspective view of the seat back tensioning assembly of FIG. 11, illustrating the back side that faces towards the user in an extended configuration.
Figure 14:
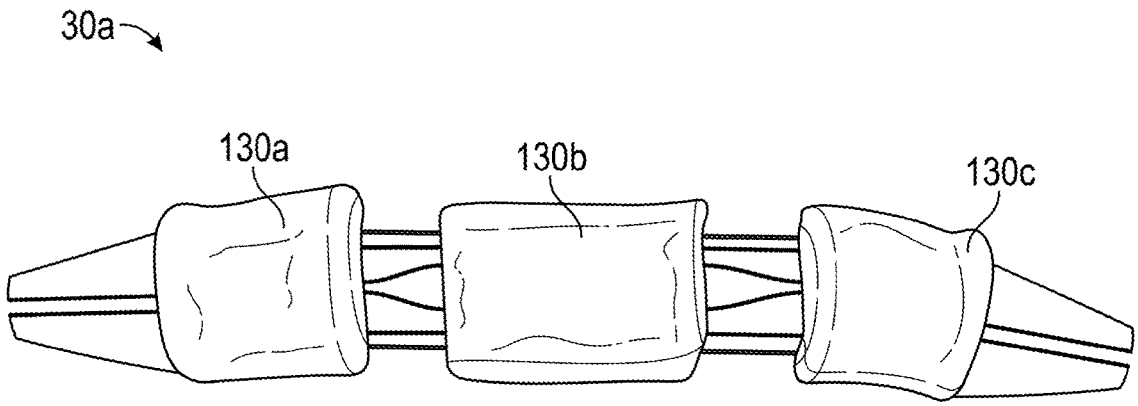
FIG. 14 is a perspective view of the seat back tensioning assembly of FIG. 11, illustrating the front side that faces towards the user in the extended configuration.

FIGS. 11-17 illustrate another embodiment of the seat back tensioning assembly 30*a*. For ease of understanding, like numbers will identify like components. With reference to FIGS. 11-14, the seat back tensioning assembly 30*a* includes a plurality of pads 130 (or supports 130). In the illustrated embodiment, the seat back tensioning assembly 30*a* includes three pads 130 (a first pad 130*a*, a second or central pad 130*b*, and a third pad 130*c*). However, in other embodiments, the seat back tensioning assembly 30*a* can include any suitable number of pads, including one, two, three, or four or more pads 130. The pads 130 are spaced apart, but interconnected by a fastener 134. As illustrated in FIG. 13, the fastener 134 is an elastic cord 134 (e.g., a bungee cord, etc.) formed of one or more elastic strands (not shown). The elastic cord 134 can be received by apertures 138 positioned in each pad 130 to thread (or interconnect) the pads 130. In the illustrated embodiment, a first elastic cord 134*a* extends from inside the first pad 130*a*, where a portion of the elastic cord 134*a* is retained, exits the first pad 130*a* through apertures 138, and travels to the second pad 130*b*. At the second pad 130*b*, the elastic cord 134*a* is received by corresponding apertures 138 in the second pad 130*b*, where the elastic cord 134*a* enters inside the second pad 130*b*, and a portion of the elastic cord 134*a* is retained within the second pad 130*b*. Similarly, a second elastic cord 134*b* extends from inside the third pad 130*c*, where a portion of the elastic cord 134*b* is retained, exits the third pad 130*c* through apertures 138, and travels to the second pad 130*b*. At the second pad 130*b*, the elastic cord 134*b* is received by corresponding apertures 138 in the second pad 130*b*, where the elastic cord 134*b* enters inside the second pad 130*b*, and a portion of the elastic cord 134*b* is retained within the second pad 130*b*. While the illustrated embodiment includes two separate elastic cords 134*a, b* that respectively connect the first pad 130*a* to the second pad 130*b*, and the third pad 130*c* to the second pad 130*b*, in other embodiments a single elastic cord 134 can be used to interconnect the pads 130*a, b, c*. For example, the elastic cord 134 can be weaved between the pads 130*a, b, c*. The elastic cord(s) 134 can include a bias. For example, the cord(s) 134 can be biased in a contracted configuration (shown in FIGS. 11-12), drawing the interconnected pads 130*a, b, c* together (or drawing the end pads 130*a, c* toward the center pad 130*b*). A force on one or more pads 130*a, b, c*, such as by a user sitting in the associated chair 14 (e.g., a user's back pushing against one or more of the pads 130*a, b, c*), can overcome the bias to extend or separate the pads 130*a, b, c* into an extended (or partially extended) configuration (shown in FIGS. 13-14). Once the force that overcomes the bias is removed (e.g., a user no longer sitting in the chair, etc.), the cord(s) 134 can contract (or re-contract), transitioning the pads 130*a, b, c* to the contracted configuration.

Referring back to FIG. 13, the seat back tensioning assembly 30*a* includes two tension adjustment assemblies 142*a, b*. The first tension adjustment assembly 142*a* includes an adjustable tension member 62 that is coupled to (or otherwise mounted to) the second pad 130*b*, a first guide member or channel 70 that is coupled to (or otherwise mounted to) the second pad 130*b*, and a plurality of second guide members or channels 78 that are coupled to (or otherwise mounted to) the first pad 130*a*. A cable 66 extends from the adjustable tension member 62, through the respective second guide members 78, and around the first guide member 70 to connect the first and second pads 130*a, b*. Operation of the adjustable tension member 62 and cable 66 with respect to the first and second guide members 70, 78 is the same as discussed above to facilitate an adjustment of tension of the cable 66, and more specifically to selectively increase or decrease a length of the cable 66 that extends between the pads 130*a, b*. It should be appreciated that in other embodiments, the adjustable tension member 62 and the first guide member 70 can be positioned on the first pad 130*a*, while the second guide members 78 can be positioned on the second pad 130*b*.

The second tension adjustment assembly 142*b* includes an adjustable tension member 62 that is coupled to (or otherwise mounted to) the second pad 130*b*, a first guide member or channel 70 that is coupled to (or otherwise mounted to) the second pad 130*b*, and a plurality of second guide members or channels 78 that are coupled to (or otherwise mounted to) the third pad 130*c*. A cable 66 extends from the adjustable tension member 62, through the respective second guide members 78, and around the first guide member 70 to connect the second and third pads 130*b, c*. Operation of the adjustable tension member 62 and cable 66 with respect to the first and second guide members 70, 78 is the same as discussed above to facilitate an adjustment of tension of the cable 66, and more specifically to selectively increase or decrease a length of the cable 66 that extends between the pads 130*b, c*. It should be appreciated that in other embodiments, the adjustable tension member 62 and the first guide member 70 can be positioned on the third pad 130*c*, while the second guide members 78 can be positioned on the second pad 130*b*.

Figure 11:
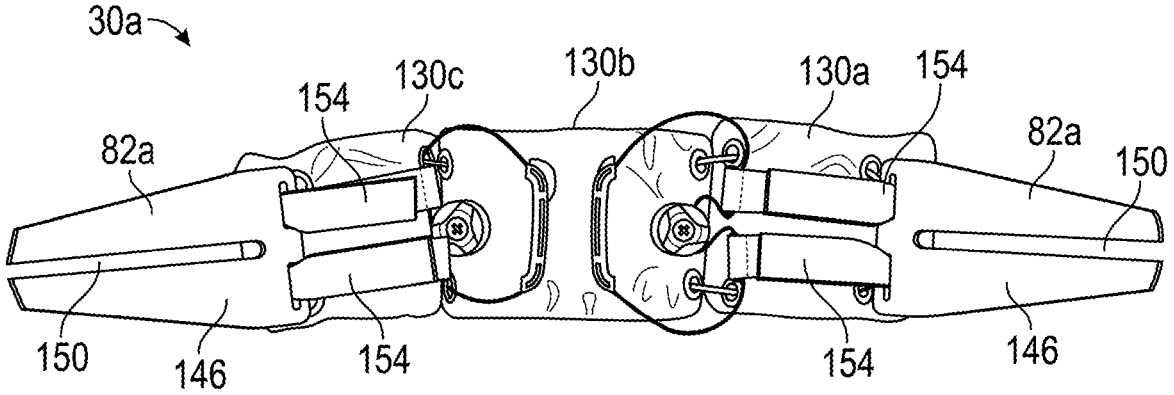
FIG. 11 is a perspective view of another embodiment of the seat back tensioning assembly for use with the chair of FIG. 1, illustrating a back side that faces away from the user in a contracted configuration.
Figure 12:
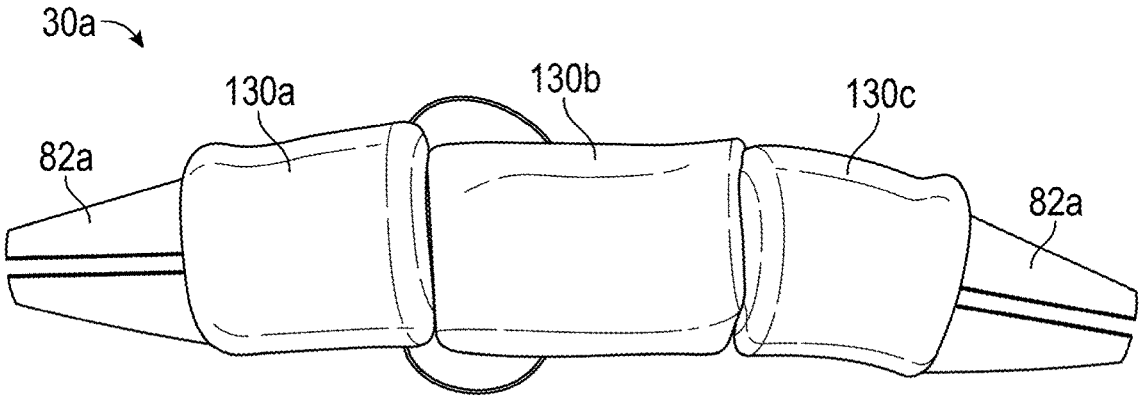
FIG. 12 is a perspective view of the seat back tensioning assembly of FIG. 11, illustrating a front side that faces towards the user in the contracted configuration.
Figure 15:
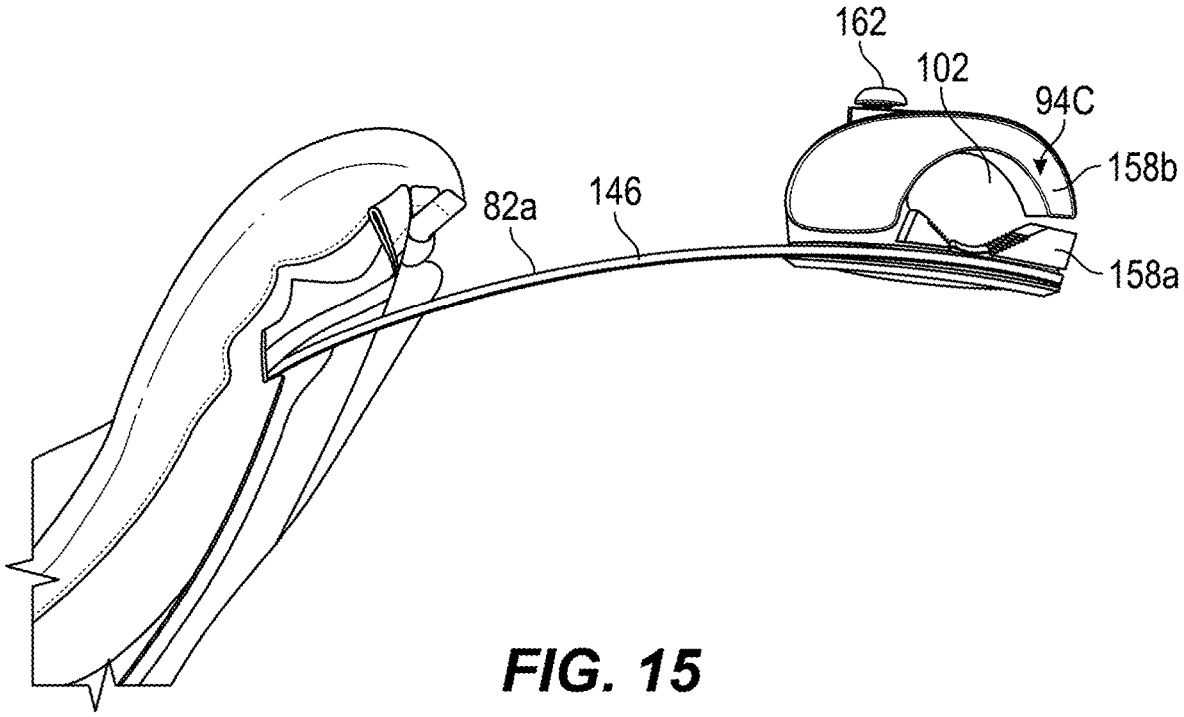
FIG. 15 is a top down view of the seat back tensioning assembly of FIG. 11, illustrating the depth adjustment bracket in sliding engagement with the width adjustment bracket.

Referring back to FIGS. 11-12, the seat back tensioning assembly 30*a* can include a depth adjustment bracket 82*a* that facilitates a connection between the seat back tensioning assembly 30*a* and the respective seat back support members 26. As best illustrated in FIG. 11, each depth adjustment bracket 82*a* can have a generally triangular side profile, along with an arcuate (or curved) body 146, which is shown in FIG. 15. A channel 150 can be defined by the body 146. In the illustrated embodiment, the channel 150 generally bisects (or is centrally positioned) along a portion of the body 146, and extends from an end of the body 146 a distance into the body. However, in other embodiments, the channel 150 can be positioned along any suitable portion of the body 146. The depth adjustment bracket 82*a* couples to the respective first or third pads 130*a, c* by a fastener 154. In the illustrated embodiment, the fastener 154 is illustrated as one or more straps 154 that each includes a hook-and-loop type fastener to fasten one of the depth adjustment brackets 82*a* to the respective first or third pads 130*a, c*. In other embodiments, the fastener 154 can be a single strap, two straps, or three or more straps, and/or can be any suitable fastener or fastening device (e.g., a snap button or snap fastener, a snap hook, etc.).

Figure 16:
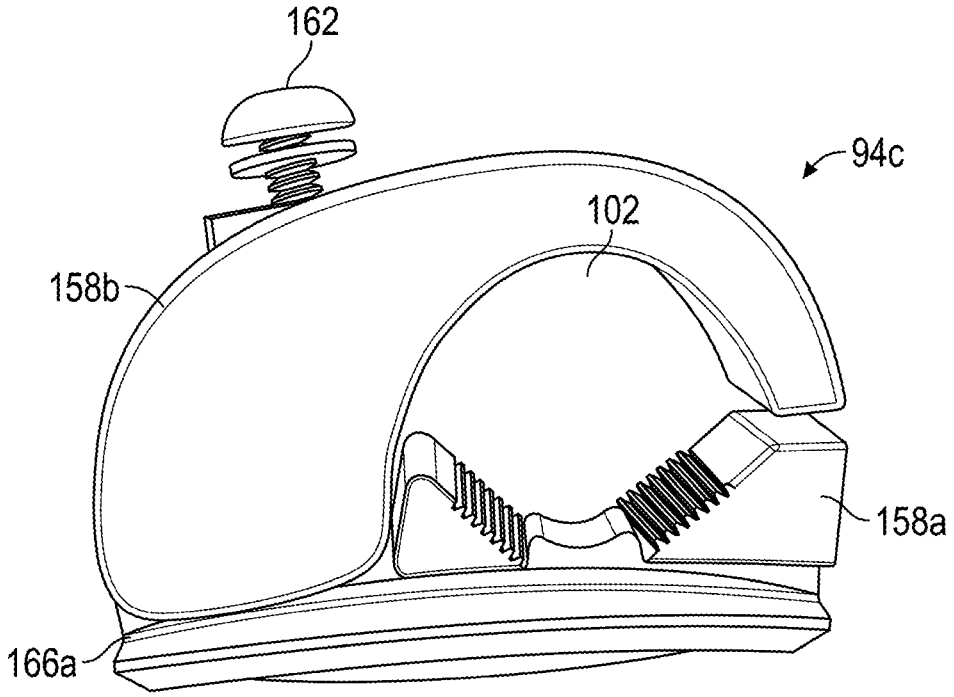
FIG. 16 is a first side view of the width adjustment bracket for use with the seat back tensioning assembly of FIG. 11.
Figure 17:
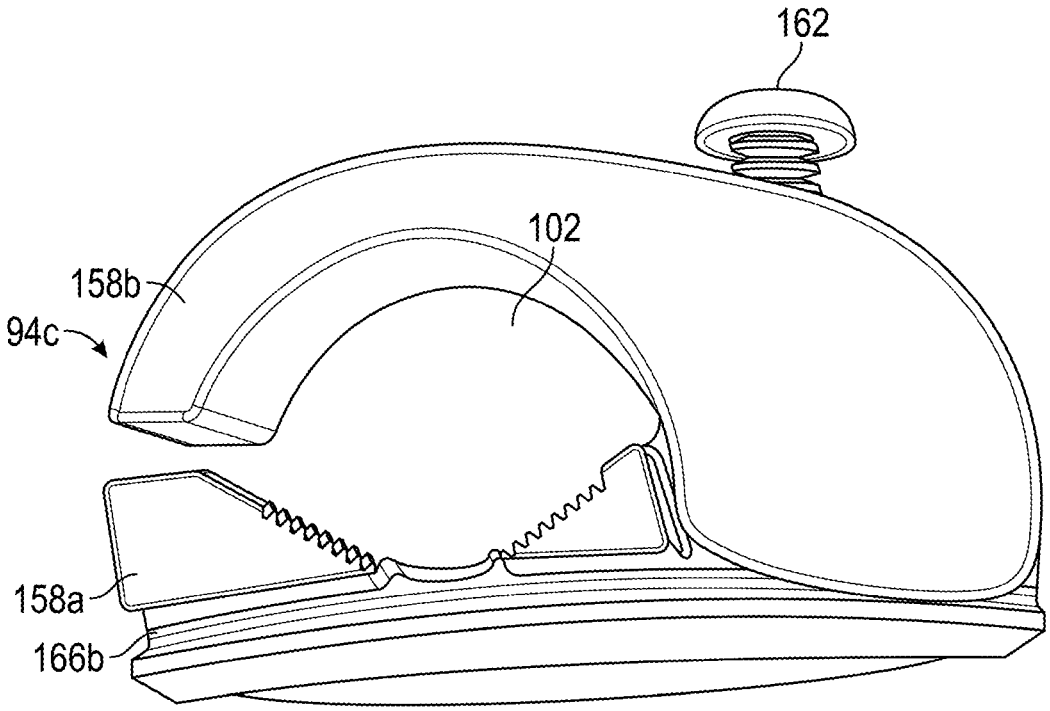
FIG. 17 is a second side view, opposite the first side view, of the width adjustment bracket of FIG. 16.

With reference to FIG. 15, the depth adjustment bracket 82*a* is configured to engage with a width adjustment bracket 94*c*. As illustrated in FIGS. 15-16, the embodiment of the width adjustment bracket 94*c* includes a pair of opposing arms 158*a, b* that are coupled together by a fastener 162 (shown as a screw 162). The arms 158*a, b* together define a channel 102 that is configured to receive, couple to, or otherwise engage one of the seat back support members 26. In the illustrated embodiment, the width adjustment bracket 94*c* is shown as a cane clamp 94*c*. As illustrated in FIGS. 16-17, one of the arms 158*a* (or the first arm 158*a*) also includes opposing, spaced apart slots 166*a, b* that positioned on opposing sides of the arm 158*a*. The slots 166*a, b* are configured to be received by the channel 150 of the depth adjustment bracket 82*a*. The slots 166*a, b* are offset and generally parallel, and have a complimentary arcuate (or curved) shape as the body 146 to facilitate a sliding connection between the depth adjustment bracket 82*a* and the width adjustment bracket 94*c* along a length of the channel 150.

To adjust a depth of the seat back tensioning assembly 30*a* in relation to the associated back support member 26, the depth adjustment bracket 82*a* can be laterally adjusted, or can slide, relative to the width adjustment bracket 94*c*. More specifically, the depth adjustment bracket 82*a* is repositioned with respect to the width adjustment bracket 94*c*, such that the width adjustment bracket 94*c* slides along (or within) the channel 150 of the depth adjustment bracket 82*a* to a desired depth position. In addition, or alternatively, to adjust the depth of the seat back tensioning assembly 30*a* in relation to the associated back support member 26, the adjustable tension member(s) 62 can be actuated to increase or decrease the length of exposed cable 66. Exposing more cable 66 (e.g., increasing the length of exposed cable 66) can provide an increase in depth relative to the back support members 26, while exposing less cable 66 (e.g., decreasing the length of exposed cable 66) can provide a decrease in depth relative to the back support members 26.

To adjust a width of the seat back tensioning assembly 30*a*, the width adjustment bracket 94*c* can rotate with respect to the back support member 26 (for example about the axis A, shown in FIG. 7). The width adjustment bracket 94*c* rotates in the same manner as the width adjustment bracket 94 discussed above.

To adjust a height of the seat back tensioning assembly 30*a* in relation to the back support members 26, each width adjustment bracket 94*c* is configured to slide with respect to the back support member 26 to which it attaches. Stated another way, each width adjustment brackets 94*c* slidably engages the associated back support members 26, and is configured to slide along the associated back support members 26 to a desired height or position on the associated back support members 26.

It should be appreciated that one seat back tensioning assembly 30*a* or a plurality of the seat back tensioning assemblies 30*a* can extend between the associated back support members 26 to define a seat back (or back of the chair 14).

Figure 18:
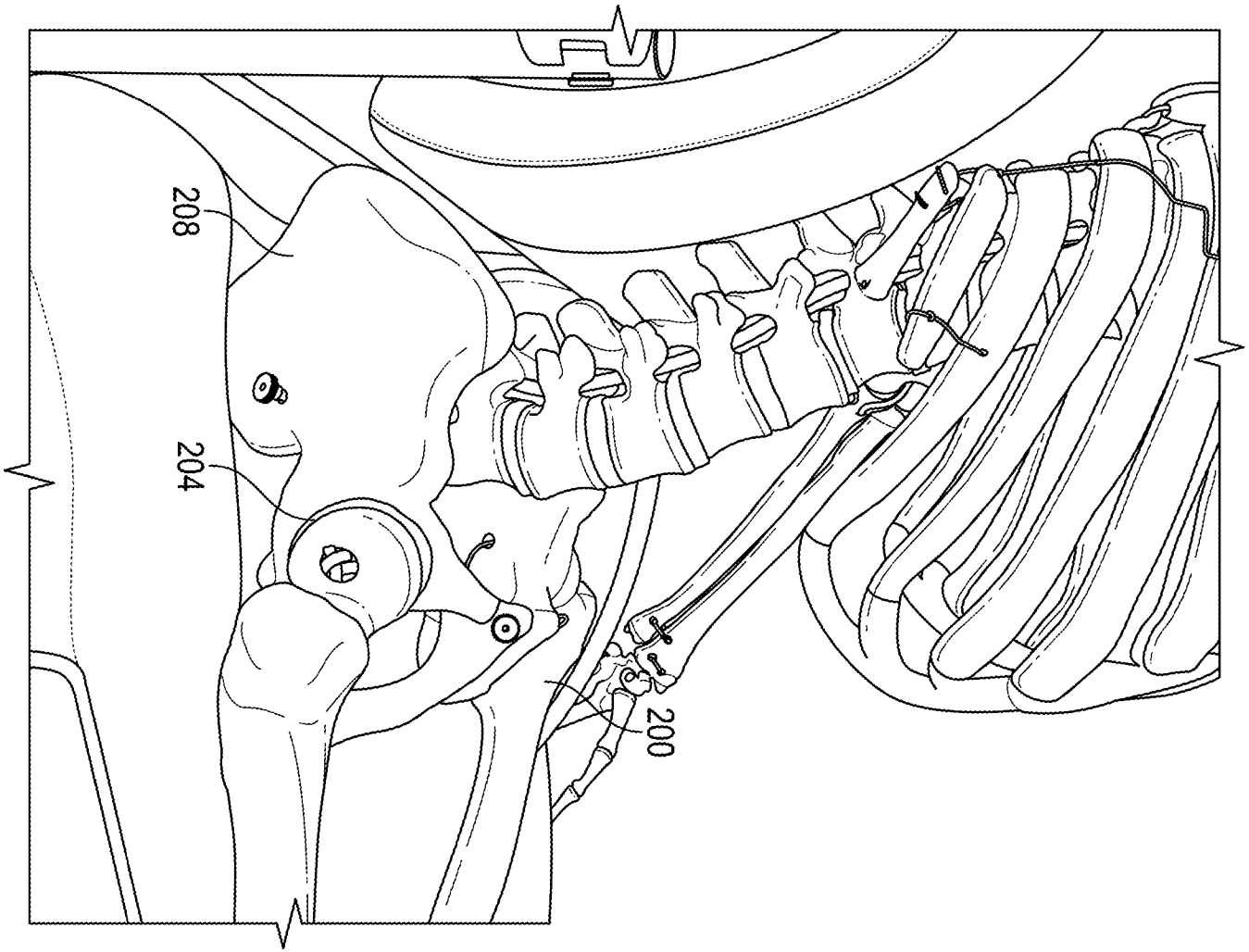
FIG. 18 is a perspective view of a known seat illustrating a user in an undesirable sitting position where the user is sitting by pivoting about the pelvis.
Figure 19:
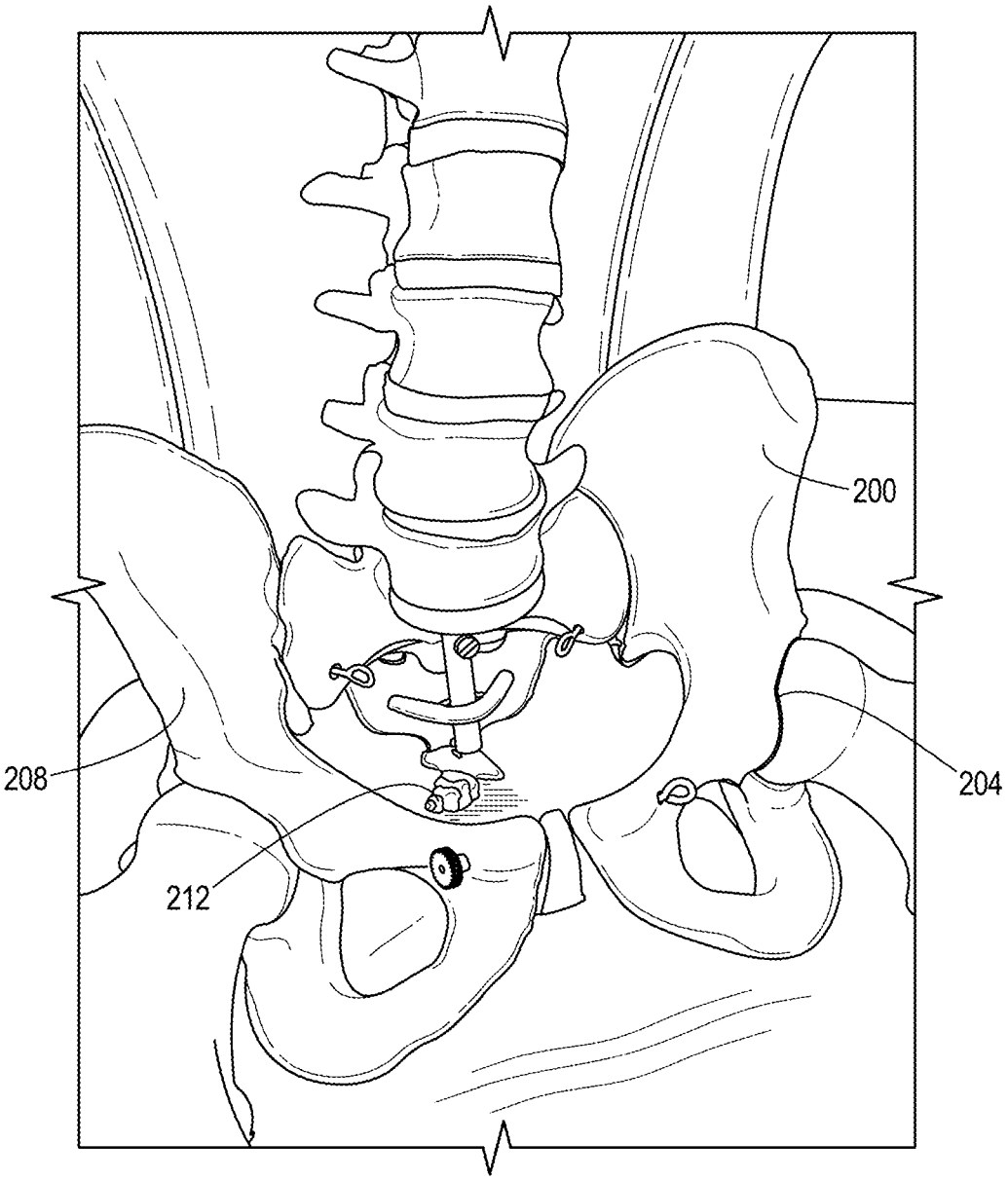
FIG. 19 is a front elevation view of the user of FIG. 18, illustrating undue pressure on the user's tailbone.

FIGS. 18-19 illustrate a traditional seat without the seat bottom adjustment assembly 38. In these seats, a user 200 (illustrated as a skeleton) is typically in an undesirable sitting position. The user 200 is not sitting by pivoting about the acetabulum 204, which is a desired position. Instead, the user 200 is sitting by pivoting about the pelvis 208, placing undue pressure on a tailbone 212 (shown in FIG. 19).

Figure 20:
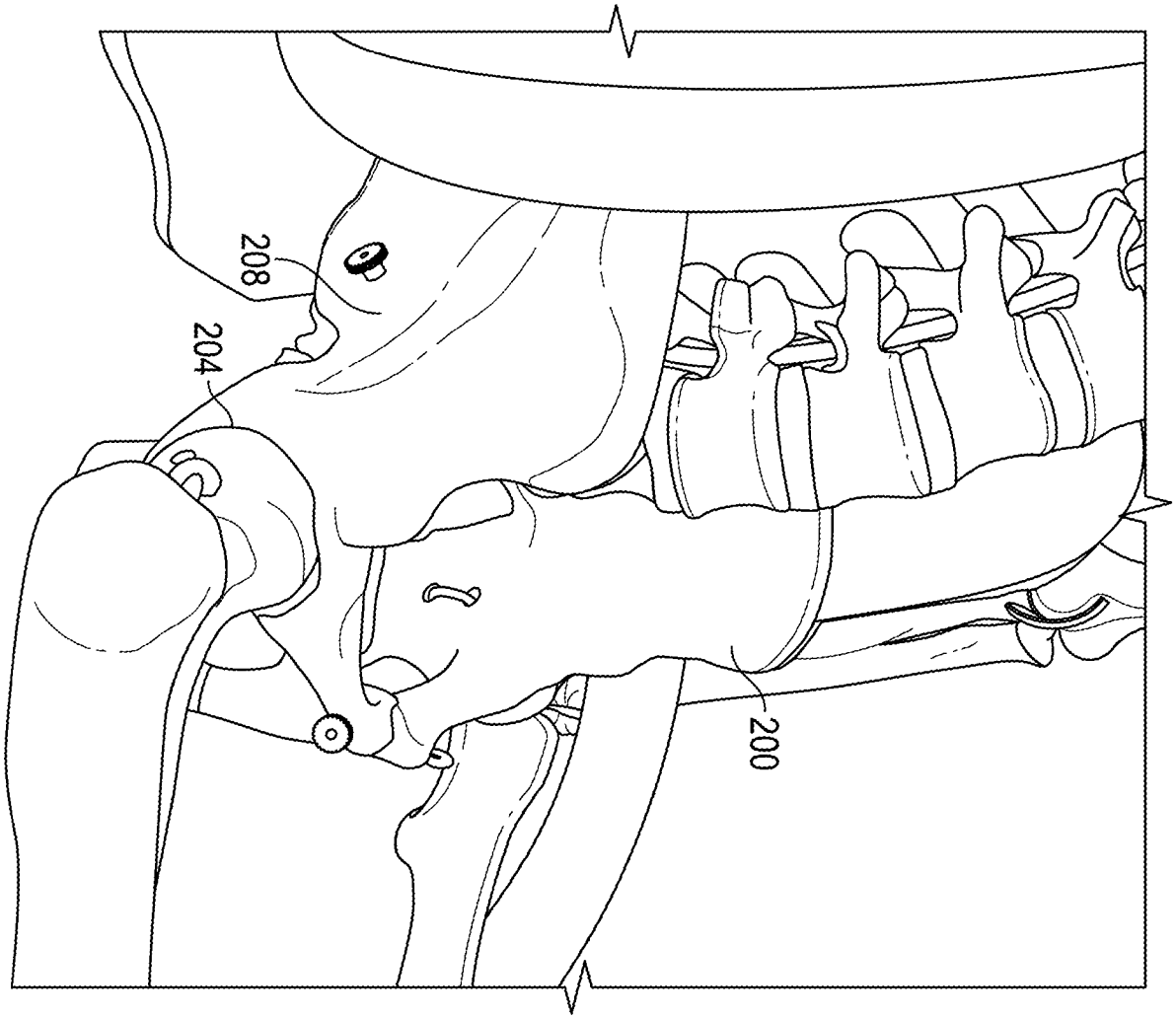
FIG. 20 is a perspective view of a seat after being adjusted with the seat bottom adjustment assembly, illustrating a user in a desirable sitting position where the user is sitting by pivoting about the acetabulum, the seat lifting the pelvis.
Figure 21:
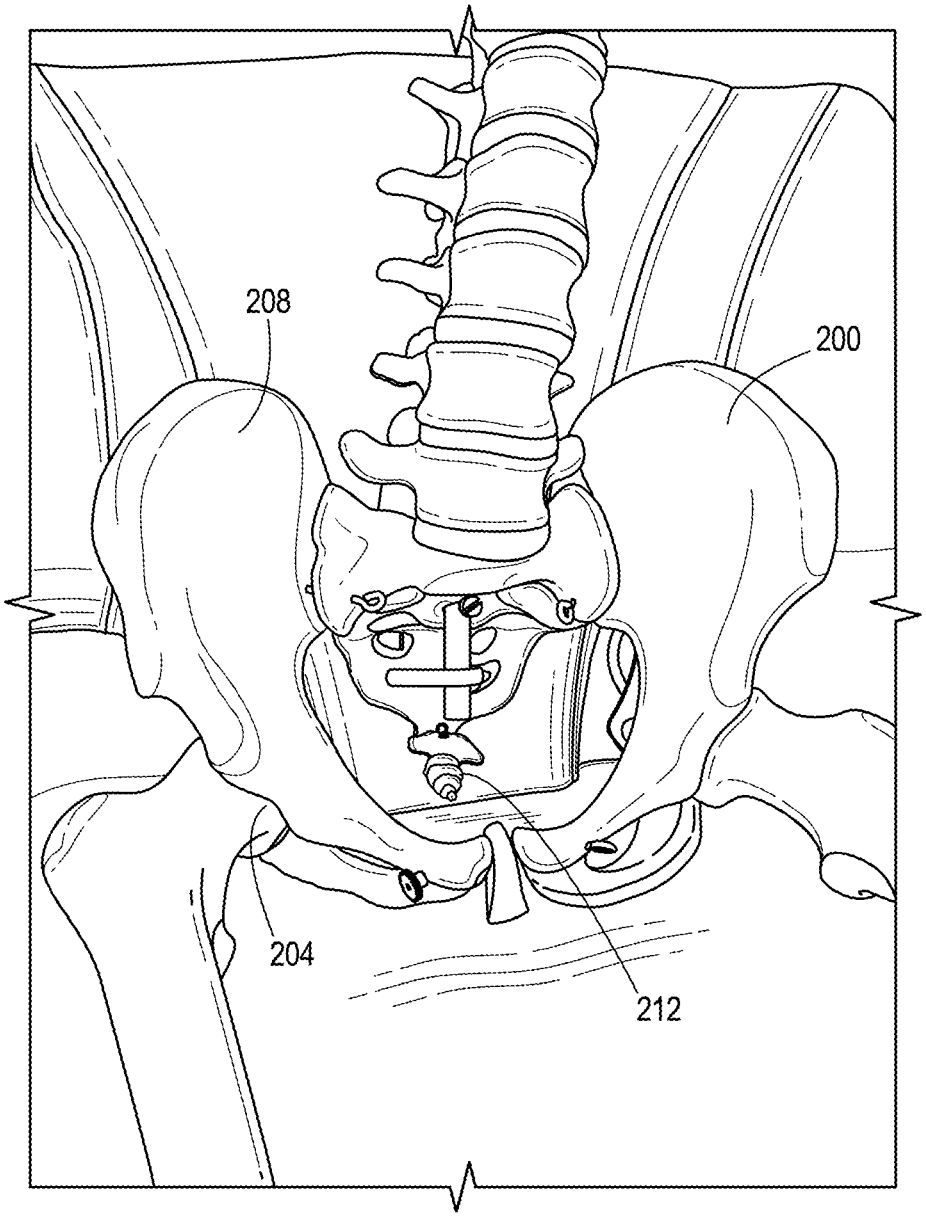
FIG. 21 is a front elevation view of the user of FIG. 20, illustrating a reduction in pressure on the user's tailbone by proper positioning of the pelvis.

FIGS. 20-21 illustrate the seat 18 in an adjusted position following proper adjustment of the seat bottom adjustment assembly 38. In this position, the user 200 is in a desirable sitting position. The user 200 is sitting by pivoting about the acetabulum 204, which lifts the pelvis 208 into a pelvic neutral position and reduces pressure on the tailbone 212 (shown in FIG. 21). Stated another way, the seat bottom adjustment assembly 38 adjusts the seat 18 to provide posterior lateral gluteus tissue lift to help give an anterior tilt to the pelvis 208, pivoting the pelvis 208 about the acetabulum 204 to achieve a more pelvic neutral position. The seat effectively cradles the user 200, while also increasing surface area of the seat 18 in contact with the user 200, advantageously redistributing pressure.

One or more aspects of the adjustable chair support system 10, including the seat back tensioning assembly 30, seat back width and depth adjustment assembly 34, and/or the seat bottom adjustment assembly 38 provides certain advantages. For example, the system 10 can be used not only to provide improved user support, but also acts as an orthotic to change a user's sitting position (e.g., pelvis position while sitting, etc.). The system 10 reduces weight of the chair 14 by minimizing (or eliminating) a frame or an apertured shell seat back. Further, the system 10 can be adjusted while the user is sitting in the chair 14. This is very advantageous when the chair 14 is a wheelchair being used by a user who has an injury or nonuse of an appendage (e.g., legs, etc.), where repeatedly moving and/or removing the user can be time intensive and difficult. In addition, by minimizing (or eliminating) the frame or apertured shell seat back, the system 10 can more effectively contour to the body of the user, improving user support and sitting position. These and other advantages are realized by the disclosure provided herein.

What is claimed is:

1. An adjustable chair support system comprising:

a first seat back support member spaced from a second seat back support member; and a seat back tensioning assembly extending between the first and second seat back support members, the seat back tensioning assembly including:

an adjustable tension member; and a cable, wherein the cable extends between the first and second seat back support members a plurality of times, and wherein the adjustable tension member is configured to adjust a length of the cable, wherein the seat back tensioning assembly is coupled to the first seat back support member by a first depth adjustment bracket.

2. The adjustable chair support system of claim 1, wherein the length of the cable extending between the first and second seat back support members decreases in response to actuation of the adjustable tension member in a first direction.

3. The adjustable chair support system of claim 2, wherein actuation of the adjustable tension member in the first direction includes rotating a portion of the adjustable tension member.

4. The adjustable chair support system of claim 1, wherein the length of the cable extending between the first and second seat back support members increases in response to actuation of the adjustable tension member in a second direction.

5. The adjustable chair support system of claim 4, wherein the actuation of the adjustable tension member in the second direction includes sliding the portion of the adjustable tension member along an axis of rotation of the portion of the adjustable tension member.

6. The adjustable chair support system of claim 5, wherein the axis of rotation is perpendicular to a carrier configured to carry the adjustable tension member.

7. The adjustable chair support system of claim 1, wherein the first depth adjustment bracket defines a channel that is configured to receive a fastener, the fastener is configured to couple the first depth adjustment bracket to the first seat back support member, and wherein the first depth adjustment bracket is configured to slide relative to the fastener along the channel to adjust a depth of the seat back tensioning assembly relative to the first seat back support member.

8. The adjustable chair support system of claim 1, wherein the first depth adjustment bracket is coupled to the first seat back support member by a first width adjustment bracket, wherein the first width adjustment bracket is configured to rotate relative to an axis defined by the first seat back support member to adjust a width of the seat back tensioning assembly.

9. The adjustable chair support system of claim 8, wherein the first width adjustment bracket is configured to slide relative to the first seat back support member to adjust a height of the seat back tensioning assembly relative to the first seat back support member.

10. An adjustable chair support system configured to be attached to a wheelchair, the adjustable chair support system comprising:

a seat back tensioning assembly extending between a first wheelchair cane and a second wheelchair cane, the seat back tensioning assembly including:

an adjustable tension member positioned between the first wheelchair cane and the second wheelchair cane; and a cable extending between the first and second wheelchair canes, the cable being in operable engagement with the adjustable tension member.

11. The adjustable chair support system of claim 10, wherein the adjustable chair support system is configured to be adjusted in a first direction by adjusting a length of the cable by actuation of the adjustable tension member.

12. The adjustable chair support system of claim 10, wherein a length of the cable extending between the first and second wheelchair canes decreases in response to rotating a portion of the adjustable tension member.

13. The adjustable chair support system of claim 10, wherein a length of the cable extending between the first and second wheelchair canes increases in response to sliding a portion of the adjustable tension member along an axis of rotation of the portion of the adjustable tension member.

14. The adjustable chair support system of claim 10, the cable extending between the first and second wheelchair canes a plurality of times.

15. The adjustable chair support system of claim 10, further comprising:

a first width adjustment bracket coupled to the first wheelchair cane;

a first depth adjustment bracket coupled to the first width adjustment bracket;

a second width adjustment bracket coupled to the second wheelchair cane; and a second depth adjustment bracket coupled to the second width adjustment bracket, wherein a first end of the seat back tensioning assembly is coupled to the first depth adjustment bracket, and a second end of the seat back tensioning assembly is coupled to the second depth adjustment bracket.

16. The adjustable chair support system of claim 15, wherein:

a height of the adjustable chair support system is configured to be adjusted by sliding the first width adjustment bracket along the first wheelchair cane and by sliding the second width adjustment bracket along the second wheelchair cane, a width of the adjustable chair support system is configured to be adjusted by rotating the first width adjustment bracket relative to the first wheelchair cane around a first axis defined by the first wheelchair cane, and by rotating the second width adjustment bracket relative to the second wheelchair cane around a second axis defined by the second wheelchair cane, and a depth of the adjustable chair support system is configured to be adjusted by sliding the first depth adjustment bracket relative to the first width adjustment bracket, and by sliding the second depth adjustment bracket relative to the second width adjustment bracket.

17. An adjustable chair support system configured to be attached to a wheelchair, the adjustable chair support system comprising:

a first width adjustment bracket coupled to a first wheelchair cane;

a first depth adjustment bracket slidably connected to the first width adjustment bracket;

a second width adjustment bracket coupled to a second wheelchair cane; and a second depth adjustment bracket coupled to the second width adjustment bracket.

18. The adjustable chair support system of claim 17, wherein:

a height of the adjustable chair support system is configured to be adjusted by sliding the first width adjustment bracket along the first wheelchair cane and by sliding the second width adjustment bracket along the second wheelchair cane, a width of the adjustable chair support system is configured to be adjusted by rotating the first width adjustment bracket around a first axis defined by the first wheelchair cane, and by rotating the second width adjustment bracket around a second axis defined by the second wheelchair cane, and a depth of the adjustable chair support system is configured to be adjusted by sliding the first depth adjustment bracket relative to the first width adjustment bracket, and by sliding the second depth adjustment bracket relative to the second width adjustment bracket.

19. The adjustable chair support system of claim 17, further comprising:

a seat back tensioning assembly having a first end opposite a second end, the first end coupled to the first depth adjustment bracket and the second end coupled to the second depth adjustment bracket, the seat back tensioning assembly including:

a cable extending between the first and second depth adjustment brackets; and an adjustable tension member in operable engagement with the cable, the adjustable tension member configured to adjust a length of the cable.

* * * * *